US006044626A

United States Patent [19]

Harper et al.

[11] Patent Number: 6,044,626

[45] Date of Patent: Apr. 4, 2000

[54] CHUCK FOR CAPPING MACHINE

[75] Inventors: Jason E. Harper, Mantua; Scott A. McSherry, Uniontown; Andrew J. Sobodosh, Novelty, all of Ohio

[73] Assignee: Pneumatic Scale Corporation, Cuyahoga Falls, Ohio

[21] Appl. No.: 09/187,963

[22] Filed: Nov. 6, 1998

[51] Int. Cl.[7] ..... B65B 7/28

[52] U.S. Cl. ..... 53/490; 53/317; 53/331.5; 53/351; 53/353

[58] Field of Search ..... 53/317, 331.5, 53/353, 354, 355, 490

[56] References Cited

U.S. PATENT DOCUMENTS

| | | | |
|---|---|---|---|
| 1,249,025 | 12/1917 | Carvalho | 53/331.5 |
| 1,673,091 | 6/1928 | Risser | 53/317 |
| 1,738,803 | 12/1929 | Stiansen | 53/317 |
| 2,076,631 | 4/1937 | Gantzer | 53/317 |
| 3,031,822 | 5/1962 | Dimond | 53/331.5 |
| 3,805,488 | 4/1974 | Holstein . | |
| 4,089,153 | 5/1978 | Long | 53/331.5 |
| 4,173,104 | 11/1979 | Koll | 53/351 |
| 4,178,733 | 12/1979 | Dankert | 53/331.5 |
| 4,267,683 | 5/1981 | Harrington . | |
| 4,357,787 | 11/1982 | Long . | |
| 4,756,137 | 7/1988 | Lanigan . | |
| 4,905,447 | 3/1990 | Margaria . | |

*Primary Examiner*—John Sipos
*Attorney, Agent, or Firm*—Daniel D. Wasil; David R. Percio; Ralph E. Jocke

[57] ABSTRACT

A chuck (10) has a jaw bell (20), a lower bell portion (22) surrounding a plurality of jaws (40) and a hub (28) surrounding an upper portion of a jaw stem (60). A second portion of the jaw stem extends beyond a jaw bell hub (28) and is surrounded by a compressed jaw stem spring (76). The jaw stem spring is retained between a bell hub collar (34) and a jaw stem collar (70). The force of the jaw stem spring holds the jaw bell around the jaws, holding the jaws in a closed position. A stripper (80) has an upper end (82) carried within the jaw stem. A stripper spring (90) located above the upper end of the stripper is compressed and surrounded by the jaw stem. The lower end of the stripper has a disk (84) with a frusto-conical cross-section in slidable contact with the jaws. The jaw stem spring exerts more force downward on the jaw bell than the stripper spring exerts downward on the stripper to hold the jaw bell around the jaws and the jaws closed. Moving the jaw bell upward further compresses the jaw stem spring so that the force of the stripper spring moves the stripper downward, thereby moving the jaws downwardly and outwardly from the jaw bell to open the jaws.

8 Claims, 5 Drawing Sheets

CHUCK FOR CAPPING MACHINE

TECHNICAL FIELD

This invention relates to a chuck for a bottle capper, the chuck having jaws and a stripper, and more specifically to a chuck in which a stripper spring forces the stripper downward to open the jaws.

BACKGROUND ART

There are a number of bottle capping machines currently used to apply screw caps onto bottles. In general such machines employ a reciprocating mechanism to reciprocate a screw cap applying spindle assembly through a capping cycle. A screw cap chuck, typically constructed of a tool grade steel, is attached to the spindle. These machines operate at a predetermined downward stroke while applying a pre-determined torque to the screw cap. The operating height of the chuck is usually adjustable to allow for various bottle heights.

The primary elements of the screw-on capping chuck are chuck jaws, a jaw bell, a stripper, a spring and a stem. The jaws are retained in the bell by the stem as it is acted upon by the spring. An adaptor connects the chuck to a spindle sleeve and transmits the rotary motion of the spindle sleeve. A push rod extends through the sleeve and is adapted to actuate the stripper. The chuck jaws are opened by reciprocal movement of the spindle sleeve upward forcing the stripper between the chuck jaws. The cap is then picked up by reciprocal movement of the spindle sleeve downward onto the cap which displaces the stripper, allowing the jaws to close. The cap is then screwed onto the container. When the cap has been placed on the container to a specified position, the jaws are opened to release the capped container. The jaws are opened by holding the jaw stem fixed longitudinally and moving the spindle longitudinally upward, thereby allowing the jaw bell to move longitudinally relative to the jaws. This relative movement between the jaw bell and the jaws allows the stripper to move longitudinally downward to open the jaws.

There are a number of applications for machines of this type where high speeds and precise torque are required. For example, the pharmaceutical, personal care and food industries make extensive use of these machines when packaging products for distribution. Chucks have required a substantial amount of force to be transferred through many components. The many components through which the force has to be transferred cause an increase in the time it takes to separate the chuck from the cap. This slower separation causes slipping of the jaws on the cap contributing to premature jaw wear. The magnitude of the force required also causes premature jaw wear.

Chucks made in accordance with the prior art are limited in the size of the caps they can apply, due to how wide the jaws can be opened for large caps, which require a larger jaw opening capability. In order to open wide enough to separate from larger caps, chucks of the prior art must be raised higher. Some capping machines do not have sufficient vertical space available to allow the chucks made in accordance with the prior art to be raised high enough.

Thus there exists a need for a chuck apparatus for a capping machine which permits quick, efficient and convenient acquisition and holding of small and large caps, followed by release of the cap using minimal force thereby reducing wear of chuck components.

DISCLOSURE OF INVENTION

It is an object of the present invention to provide a chuck for a capping machine which requires minimal force to open.

It is a further object of the present invention to provide a chuck for a capping machine which reduces wear of chuck jaws during repeated operation.

It is a further object of the present invention to provide a chuck for a capping machine which has jaws which can open wide enough to accommodate large caps.

It is a further object of the present invention to provide a chuck for a capping machine which has jaws which can open wide enough to accommodate large caps with limited vertical of the chuck.

It is a further object of the present invention to provide a chuck for a capping machine which accommodates variations in container heights.

The foregoing objects are accomplished in a preferred embodiment of the invention by a chuck apparatus for a capping machine in which clamping force for the jaws is provided by a first spring and opening force for the jaws is provided by movement of a stripper urged downward by the force of a second spring.

Further objects of the present invention will be made apparent in the following Best Mode For Carrying Out Invention and the appended claims.

BEST MODE FOR CARRYING OUT INVENTION

Figure 1:
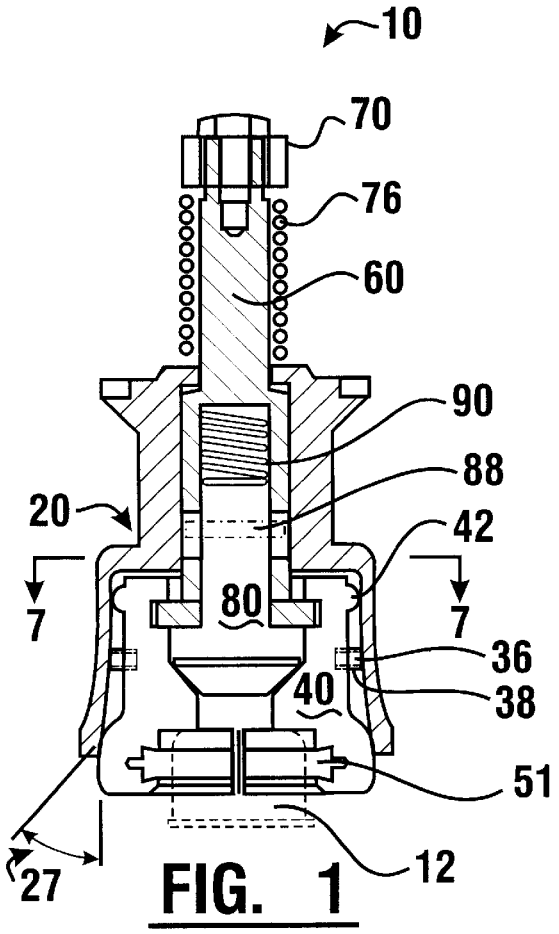
FIG. 1 is a cross-sectional view of a preferred embodiment of a chuck of the present invention with jaws in a closed position.
Figure 2:
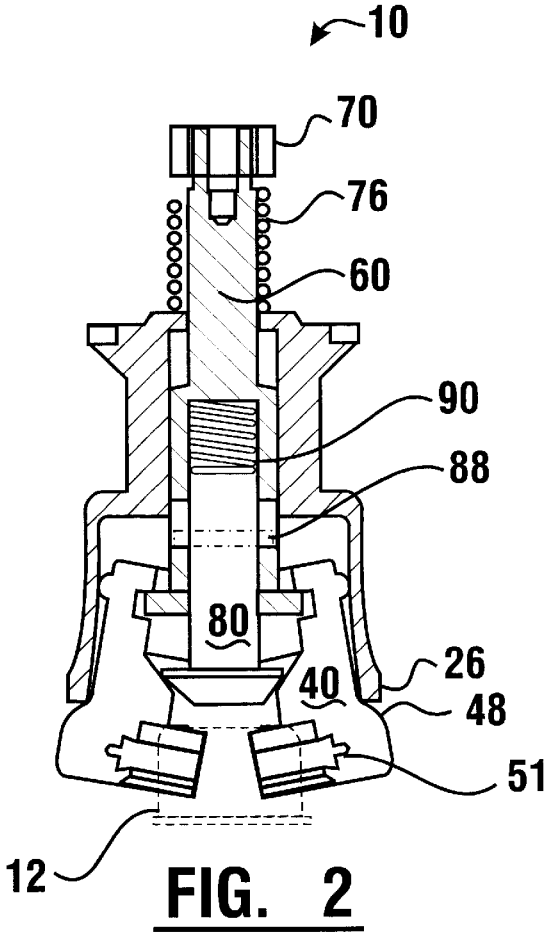
FIG. 2 is a cross-sectional view of a preferred embodiment of a chuck of the present invention with jaws in an open position.

A preferred embodiment of a chuck 10 of the present invention is generally shown in FIGS. 1 and 2. Chuck 10 has a jaw bell 20, a plurality of jaws 40, a spindle or jaw stem 60 and a sleeve or stripper 80. In FIG. 1 chuck 10 is shown with jaw bell 20 in an extended position and jaws 40 in closed positions holding a cap 12 shown in phantom. In FIG. 2 chuck 10 is shown with jaw bell 20 in a retracted position and jaws 40 in open positions.

Figure 3:
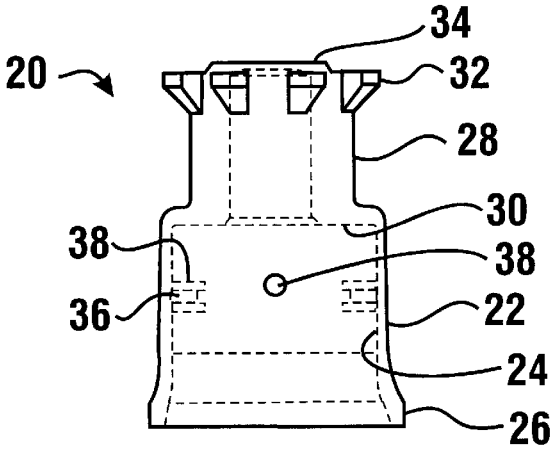
FIG. 3 is a cross-sectional view of a jaw bell of the chuck shown in FIGS. 1 and 2.
Figure 4:
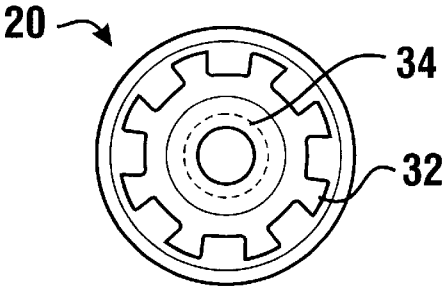
FIG. 4 is an end view of the jaw bell shown in FIG. 3

As shown in FIGS. 3 and 4, jaw bell 20 has a lower bell portion 22. Lower bell portion 22 has a wall 24 which is preferably flared outwardly slightly longitudinally and annular in cross-section. In this embodiment wall 24 flares outwardly beginning at approximately midway between its upper end and lower end at an angle 27 of approximately 6.9° from the vertical. Further, at the flared end of wall 24 the thickness of wall 24 is increased to form a lip 26.

Figure 5:
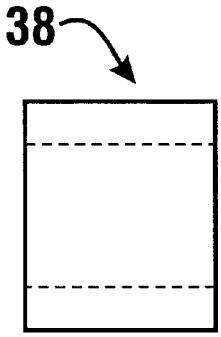
FIG. 5 is a side view of a pin roller in the jaw bell shown in FIGS. 1,2 and 5A
Figure 5A:
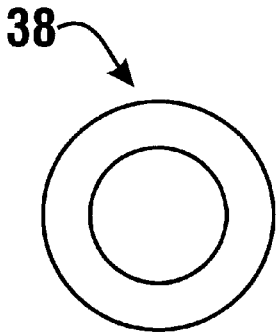
FIG. 5A is an end view of a pin roller in the jaw bell shown in FIGS. 1, 2 and 5.

Lower bell portion 22 at least one post 36 extending radially inward from the inner surface of wall 24. As shown in FIG. 5, pin 36 has a roller 38 rotatably mounted thereon. The functions of pin 36 and roller 38 will be described in more detail later.

Referring again to FIGS. 3 and 4, jaw bell 20 at an upper portion has a hub 28. Hub 28 at a first end has a shoulder 30. At shoulder 30 the outside diameter of lower bell portion 22 is reduced to match the outside diameter of hub 28. Hub 28 is annular in cross-section. At a second end of hub 28 is at least one lug 32 which extends outwardly from the outer wall of hub 28. Hub 28 also has a collar 34 which extends inwardly from the inner wall of hub 28. The functions of lug 32 and collar 34 will be described in more detail later.

Figure 6:
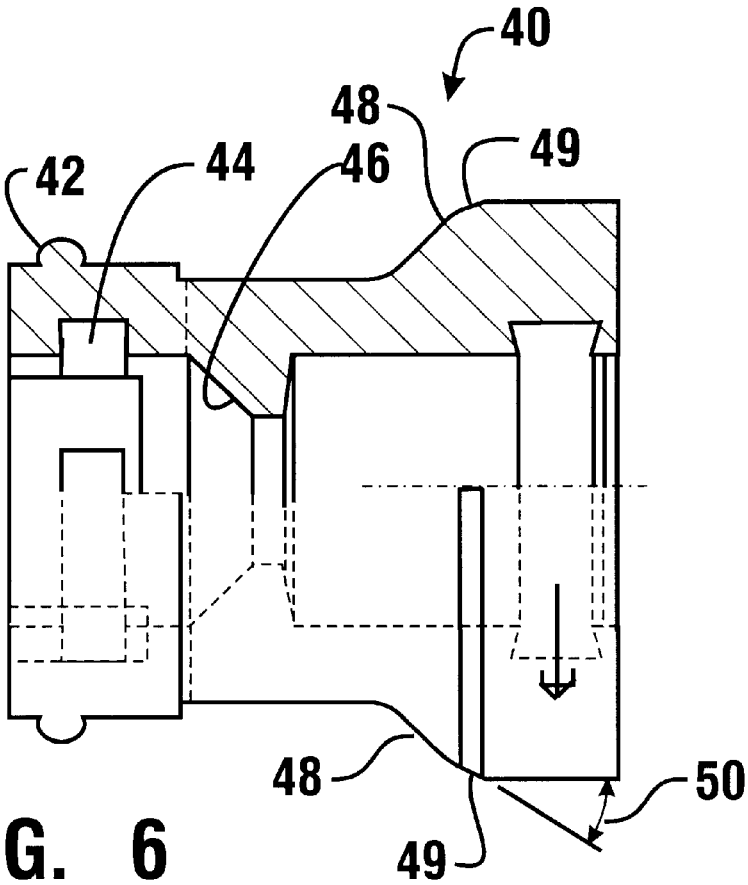
FIG. 6 is a cross-sectional view of a jaw shown in FIGS. 1 and 2.
Figure 7:
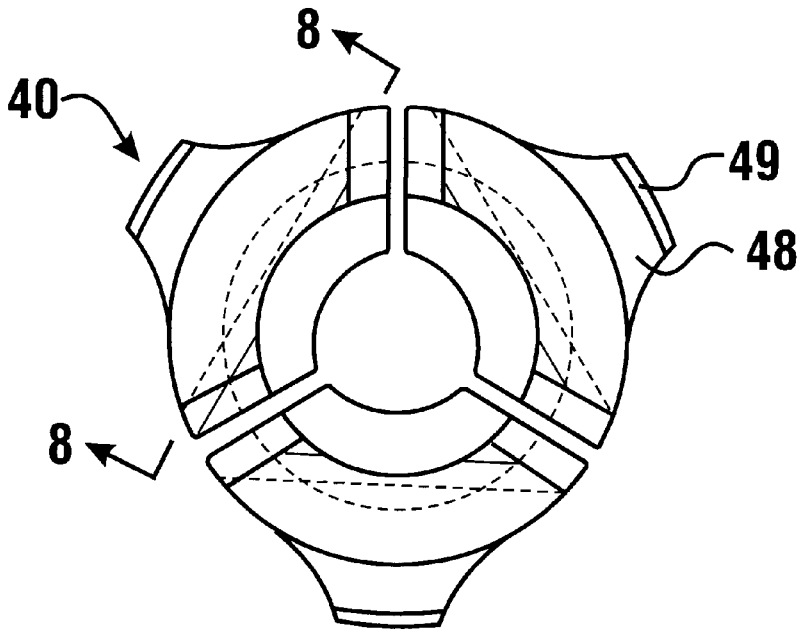
FIG. 7 is a plan view of three jaws shown in FIG. 1 along line 7—7.
Figure 8:
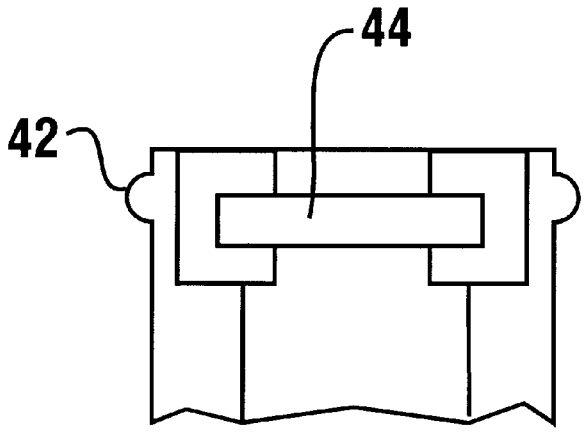
FIG. 8 is a partial view of a jaw insert along line 8—8 in FIG. 7.
Figure 9:
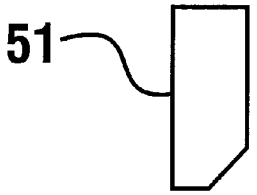
FIG. 9 is a cross-sectional view of a jaw insert.

As shown in FIG. 6 and 7, jaw 40 has a fulcrum 42 on a surface adjacent the inner surface of jaw bell wall 24. Fulcrum 42 is preferably disposed toward the upper end of jaw 40 and has a rounded outer surface. Jaw 40 has an inner shoulder 46 and an outer shoulder 48. Outer shoulder 48 has a shoulder end 49 at which outer shoulder 48 turns downwardly. Shoulder end 49 is at an angle 50 with respect to vertical. In the preferred embodiment the angle 50 is approximately 22.5°. Jaw 40 also has a channel 44, also shown in FIG. 8. A removable jaw insert 51 for gripping a cap is shown in FIG. 9. Different caps may require different jaw inserts of different configurations made from different materials.

Figure 10:
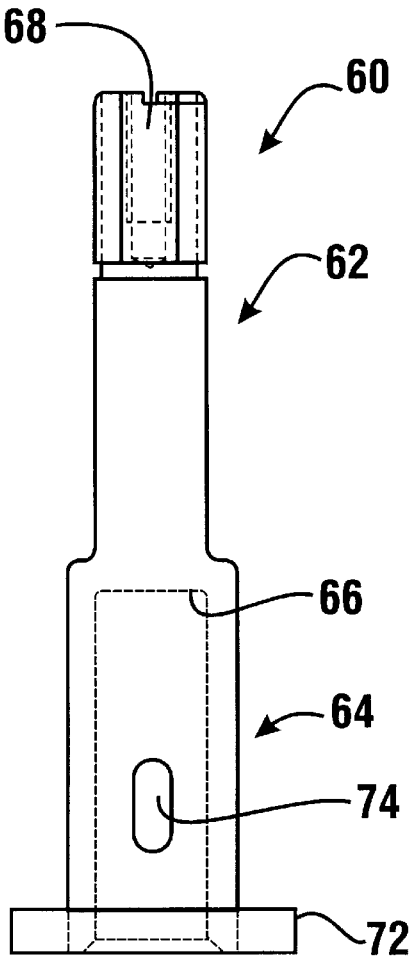
FIG. 10 is an elevational view of a jaw stem shown in FIGS. 1 and 2.
Figure 11:
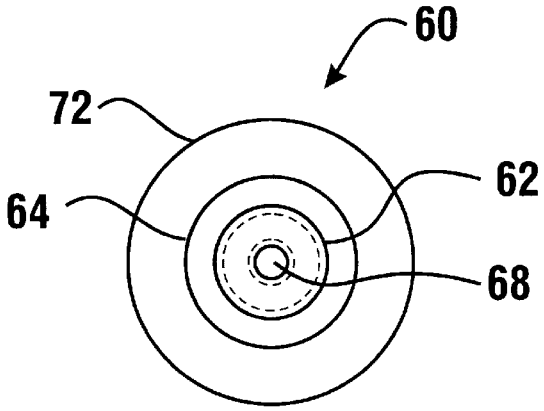
FIG. 11 is an end view of the jaw stem shown in FIG. 10.
Figure 12:
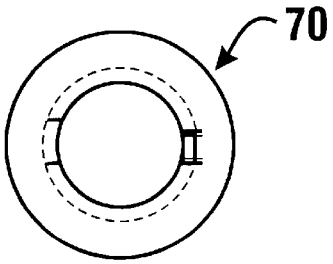
FIG. 12 is an end view of a collar shown in FIGS. 1 and 2.
Figure 13:
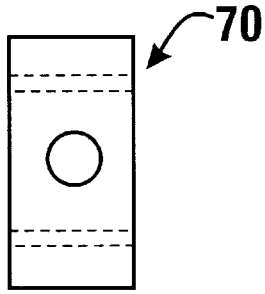
FIG. 13 is a side view of the collar shown in FIG. 12.
Figure 15:
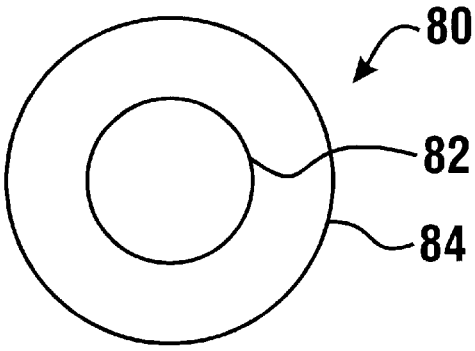
FIG. 15 is an end view of a stripper shown in FIGS. 1, 2 and 14.

Jaw stem 60 shown in FIGS. 10 and 11 is a spindle having an upper end 62 and a hollow lower end 64 which are preferably integrally connected at shoulder 66. Upper end 62 is slidable inside bell sleeve collar 34. Collar 34 prevents upper end 62 frown sliding beyond shoulder 66. Upper end 62 is externally threaded and also has an internally threaded opening 68 at an end opposite shoulder 66. A collar 70 shown in FIGS. 12 and 13 threads onto the external threads of upper end 62.

Jaw stem lower end 64 has a disk 72 preferably integrally connected thereto at an end opposite shoulder 66. Lower end 64 and disk 72 are annular in cross-section. The outer diameter of the annular cross-section of disk 72 is greater than the outer diameter of lower end 64. The outer diameter of the annular cross-section of disk 72 is small enough to allow disk 72 to fit radially within jaw channel 44. Further, the longitudinal thickness of disk 72 is smaller than the longitudinal opening of channel 44. This difference between the thickness of disk 72 and the opening of channel 44 allows chuck 10 to accommodate variations due to manufacturing and supplier tolerance in the height of various cap and container combinations. The inner diameter of lower end 64 and disk 72 are approximately the same. Lower end 64 has at least one slot 74 extending in a direction longitudinally from disk 72 toward shoulder 66 and forming a passage from the inside surface to the outside surface of lower end 64.

A jaw stem spring 76 shown in FIGS. 1 and 2 surrounds jaw stem upper end 62 and is compressed between jaw stem collar 70 and jaw bell collar 34. As jaw bell 20 slides upwardly along jaw stem upper end 62, jaw stem spring 76 is retained between jaw stem collar 70 and jaw bell collar 34 and is further compressed. The compression of jaw stem spring 76 exerts a force in a direction urging jaw stem upper end 62 outwardly from jaw bell 20.

Figure 14:
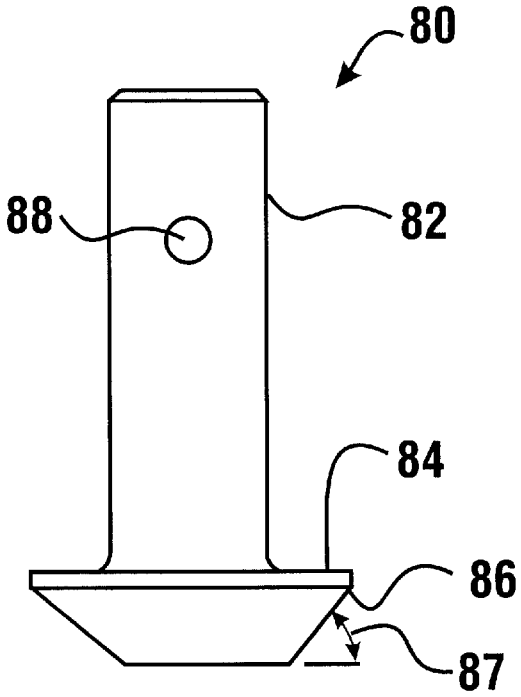
FIG. 14 is an elevational view of a stripper shown in FIGS. 1, 2 and 15.

As shown in FIG. 14, stripper 80 is a sleeve generally circular in cross-section and has an upper end 82 and a disk 84 preferably integrally connected thereto at a lower end of upper end 82. Disk 84 has a lower portion 85 which is generally frusto-conical in cross-section. Disk lower portion 85 has an outer surface 86 at an angle 87 between the axial direction of stripper 80 and a line normal to the axial direction. In the preferred embodiment angle 87 is approximately 40°. Disk outer surface 86 moves slidably along jaw inner shoulder 46.

A pin 88 extends radially through stripper 80 and is located longitudinally between stripper upper end 82 and disk 84 to permit a limited amount of relative longitudinal motion of stripper 80 inside jaw stem lower end 64 as will be described later. The length of pin 88 is less than the outside diameter of jaw stem lower end 64. The diameter of pin 88 is less than the width of jaw stem slot 74.

A stripper spring 90 has an outside diameter less than the inside diameter of jaw stem lower end 64. Stripper spring 90 is compressed and retained inside jaw stem lower end 64 above stripper upper end 82. Stripper spring 90 exerts a downward force on stripper upper end 82 urging stripper 80 outwardly from inside jaw stem lower end 64. Stripper 80 is retained within jaw stem lower end by pin 88 cooperating with jaw stem slot 74.

Referring again to FIG. 1, the operation of chuck 10 will now be described in greater detail. In the preferred embodiment shown in FIG. 1 chuck 10 is threadably connected to a spindle (not shown) by using threaded opening 68.

Three jaws 40 are positioned equidistant around the circumference of lower bell portion 22. A greater or lesser number of jaws 40 may be used, with a greater number preferable for larger caps. Jaw stem spring 76 exerts a downward force on jaw bell collar 34. The downward force exerted on jaw bell collar 34 is sufficient to cause jaw bell lip 26 to exert a force inwardly on jaw outer shoulder 48.

As jaws 40 are urged inwardly, jaw bell inner shoulder 46 in turn exerts a force on stripper disk outer surface 86. As this force is exerted on disk outer surface 86, stripper 80 is urged to move upwardly within lower bell portion 22 and jaw stem lower end 64. As stripper 80 moves upwardly within lower bell portion 22 and jaw stem lower end 64, pin 88 moves upwardly within slot 74 and stripper spring 90 is further compressed.

With chuck 10 as shown in FIG. 1 and as described above, jaws 40 grip a cap 12. To perform a capping operation chuck 10 is rotated. Jaw bell 20 rotates with rollers 38 rotatably mounted on posts 36 and engaged between jaws 40. Rollers 38 transfer torque from jaw bell 20 to jaws 40.

Referring now to FIG. 2, chuck 10 is shown in an open position. To open chuck 10 from the closed position previously described and shown in FIG. 1, an upward force through a cam or other mechanical linkage is exerted on jaw bell lug 32 to move jaw bell 20 upwardly. In the preferred embodiment, jaw bell 20 is moved upwardly approximately 0.313 inches.

Jaw stem spring 76 is retained at its upper end by jaw stem collar 70 and is further compressed by the upward movement of jaw bell collar 34. Stripper spring 90 exerts a downward force on stripper 80 and disk outer surface 86.

The force exerted by stripper spring 90 is sufficient to overcome the upward force on stripper 80 exerted by jaw inner shoulders 46, thereby preventing jaw inner shoulders 46 and jaws 40 from moving upwardly with jaw bell 20.

The relative movement of jaw bell 20 upwardly with respect to jaws 40 urges jaws 40 to slide downwardly with respect to jaw bell lip 26 and to spread outwardly as jaw outer shoulder 48 rides on jaw bell lip 26. Fulcrums 42 provide a pivot point about which jaws 40 may rotate as this outward spread occurs. Further, jaw channel 44 is sufficiently wide to permit jaw 40 to spread outwardly without binding on jaw stem disk 72. Jaw channel 44 is also sufficiently wide to accommodate variances in container height by allowing a tolerance between jaw channel 44 and jaw stem disk 72.

Stripper spring 90 exerts a downward force directly on stripper 80. This downward force is lower than was required in chucks of the prior art. Previously chucks required a substantial amount of force to be transferred through many components. Transmitting this substantial force takes enough time to permit jaw inserts 51 to slip on cap 12, thereby causing premature jaw wear. The many components also take up vertical space and make it difficult to open the jaws as wide as necessary for larger caps, particularly where vertical space is limited.

The angles at which disk outer surface 86 and jaw inner shoulder 46 engage, as well as the angles at which jaw bell lip 26 and jaw outer shoulders 48 engage, permit the jaws to open wider while requiring less vertical displacement. The combination of stripper spring 90 acting directly on stripper 80 and the stripper engagement angles permits more rapid and wider jaw opening. The more rapid jaw opening reduces premature jaw wear by having jaw inserts 51 in contact with cap 12 for a shorter time as chuck 10 rotates. The wider jaw opening permits use of chuck 10 with larger caps 12 without requiring additional vertical displacement of chuck 10 opening.

Thus the new chuck apparatus of the present invention achieves the above stated objectives, eliminates difficulties encountered in the use of prior devices and systems, solves problems and attains the desirable results described herein.

In the foregoing description certain terms have been used for brevity, clarity and understanding, however, no unnecessary limitations are to be implied therefrom because such terms are for descriptive purposes and are intended to be broadly construed. Moreover, the descriptions and illustrations herein are by way of examples and the invention is not limited to the exact details shown and described.

In the following claims any feature described as a means for performing a function shall be construed as encompassing any means capable of performing the recited function, and shall not be limited to the structures shown herein or mere equivalents.

Having described the features, discoveries and principles of the invention, the manner in which it is constructed and operated, and the advantages and useful results attained, the new and useful structures, devices, elements, arrangements, parts, combinations, systems, equipment, operations and relationships are set forth in the appended claims.

We claim:

1. A chuck for a capping machine, which capping machine applies a cap to a container by disposing the chuck holding a cap in vertically aligned relation with the container and rotating the chuck a selected amount, whereupon the cap is released from the chuck, the chuck comprising:

a rotatable vertically reciprocable spindle having a hollow lower portion and an upper portion;

a collar in releasable mechanical connection with the spindle upper portion;

an elongated sleeve rotatably carried within the spindle and having a portion protruding beneath the spindle, the sleeve protruding portion having a diameter greater than the diameter of the portion carried within the spindle;

a first spring disposed upwardly above the sleeve and within the spindle hollow lower portion, the first spring compressed and tending to urge the sleeve downwardly;

a plurality of jaws supported at the lower portion of the spindle and in adjacent surrounding relation with the sleeve protruding portion, the jaws moveable between a closed position for holding a cap and an open position for releasing a cap;

a bell shaped member disposed around the jaws including a hub portion disposed at an upper end of the bell shaped member, the hub portion having an opening through which the spindle upper portion extends;

a second spring disposed above the hub portion, the second spring in surrounding relation with the spindle upper portion, the second spring compressed and retained between the hub portion and the spindle collar, and tending to urge the bell shaped member downwardly with respect to the collar;

the bell shaped member being moveable between:

a first position wherein the second spring urges the bell shaped member downwardly overcoming the first spring urging the sleeve downwardly and retaining the jaws in a closed position; and a second position wherein the second spring is compressed between the hub portion and the spindle collar, whereupon the spindle lower portion urges the jaws downwardly with respect to the bell shaped member and the first spring urges the sleeve and sleeve protruding end downwardly with respect to the jaws urging the jaws outwardly with respect to the bell shaped member.

2. The chuck of claim 1 wherein the spindle hollow lower portion has an aperture therethrough and the sleeve portion carried within the spindle hollow lower portion has a pin protruding therefrom.

3. The chuck of claim 2 wherein the aperture surrounds the pin.

4. The chuck of claim 3 wherein the aperture is a slot having a greater length of opening along the direction in which the spindle is reciprocated than a width of opening in the direction in which the spindle is rotated.

5. The chuck of claim 4 wherein the aperture and the pin cooperate to limit the distance the sleeve is moveable inwardly and outwardly from the spindle.

6. The chuck of claim 1 wherein in the bell shaped member second position the second spring is compressed at least 0.313 inches.

7. A method for applying a cap held by a chuck of a capping machine to a container comprising:

disposing the chuck holding the cap in vertically aligned relation with the container, wherein the chuck comprises:

a rotatable vertically reciprocable spindle having a hollow lower portion and an upper portion;

a collar in releasable mechanical connection with the spindle upper portion;

an elongated sleeve rotatably carried within the spindle and having a portion protruding beneath the spindle, the sleeve protruding portion having a diameter greater than the diameter of the portion carried within the spindle;

a first spring disposed upwardly above the sleeve and within the spindle hollow lower portion, the first spring compressed and tending to urge the sleeve downwardly;

a plurality of jaws supported at the lower portion of the spindle and in adjacent surrounding relation with the sleeve protruding portion, the jaws moveable between a closed position for holding a cap and an open position for releasing a cap;

a bell shaped member disposed around the jaws including a hub portion disposed at an upper end of the bell shaped member, the hub portion having an opening through which the spindle upper portion extends;

a second spring disposed above the hub portion, the second spring in surrounding relation with the spindle upper portion, the second spring compressed and retained between the hub portion and the spindle collar, and tending to urge the bell shaped member downwardly with respect to the collar;

rotating the chuck a selected amount;

moving the chuck between a first position wherein the second spring urges the bell shaped member downwardly overcoming the first spring urging the sleeve downwardly and retaining the jaws in a closed position holding the cap; and a second position wherein the second spring is compressed between the hub portion and the spindle collar, whereupon the spindle lower portion urges the jaws downwardly with respect to the bell shaped member and the first spring urges the sleeve and sleeve protruding end downwardly with respect to the jaws urging the jaws outwardly with respect to the bell shaped member, releasing the cap from the chuck.

8. The method of claim 7 wherein in the moving step the second position is at least 0.313 inches above the first position.

* * * * *